US010066817B2

(12) United States Patent
Silver et al.

(10) Patent No.: US 10,066,817 B2
(45) Date of Patent: Sep. 4, 2018

(54) RECESSED TRACK LIGHTING FIXTURE

(71) Applicant: Beta-Calco Inc., Toronto (CA)

(72) Inventors: Remy Silver, Toronto (CA); Patrick Alan Stark, Etobicoke (CA)

(73) Assignee: BETA-CALCO INC., Toronto (CA)

( * ) Notice: Subject to any disclaimer, the term of this patent is extended or adjusted under 35 U.S.C. 154(b) by 528 days.

(21) Appl. No.: 14/657,484

(22) Filed: Mar. 13, 2015

(65) Prior Publication Data

US 2016/0265756 A1 Sep. 15, 2016

(51) Int. Cl.

| | |
|---|---|
| ***F21V 21/14*** | (2006.01) |
| ***F21S 8/02*** | (2006.01) |
| ***F21V 21/30*** | (2006.01) |
| ***F21V 21/34*** | (2006.01) |
| *F21Y 115/10* | (2016.01) |

(52) U.S. Cl.

CPC ..... *F21V 21/14* (2013.01); *F21S 8/02* (2013.01); *F21S 8/026* (2013.01); *F21V 21/30* (2013.01); *F21V 21/34* (2013.01); *F21Y 2115/10* (2016.08)

(58) Field of Classification Search

CPC ..... F21V 21/14; F21V 21/30; F21V 21/34; F21S 8/02; F21S 8/026; F21Y 2115/10

See application file for complete search history.

(56) References Cited

U.S. PATENT DOCUMENTS 3,778,609 A 12/1973 Liberman
4,238,815 A 12/1980 Price
5,289,358 A 2/1994 Halemeier
5,291,381 A * 3/1994 Price ..... F21V 21/04 248/291.1
5,412,552 A * 5/1995 Fernandes ..... F21S 2/00 174/101
5,826,970 A 10/1998 Keller
6,004,011 A 12/1999 Sieczkowski
6,036,337 A * 3/2000 Belfer ..... F21S 8/02 362/257

(Continued)

OTHER PUBLICATIONS

Canadian Examiner's Report dated Nov. 1, 2016, for corresponding Canadian Patent Application No. 2,894,842.

(Continued)

*Primary Examiner* — Anh Mai
*Assistant Examiner* — Fatima Farokhrooz
(74) *Attorney, Agent, or Firm* — Renner, Otto, Boisselle & Sklar, LLP

(57) ABSTRACT

A recessed track lighting fixture and an angular adjustment mechanism for the light fixture are disclosed. The fixture includes a first side member and a second side member. A linear support track is defined between the first and second side members. A displacement member is supported by the support track and is displaceable along at least a portion of the support track. A luminaire is at least partially disposed between the first and second side members, the luminaire being supported by the displacement member and displaceable therewith. The angular adjustment mechanism includes a support bracket coupled to the housing, an arcuate slot in the support bracket and a plurality of positioning apertures. A pin is coupled to the luminaire for sliding in the arcuate slot. A positioning nub is coupled to the luminaire and can be received by a positioning aperture to position the luminaire at a desired position.

44 Claims, 15 Drawing Sheets

(56) References Cited

U.S. PATENT DOCUMENTS

| | | | | |
|---|---|---|---|---|
| 6,634,764 | B2 | 10/2003 | Kotovsky | |
| 6,652,124 | B2 * | 11/2003 | Schubert | F21S 8/02 362/148 |
| 6,779,907 | B2 | 8/2004 | Beadle | |
| 7,186,008 | B2 | 3/2007 | Patti | |
| 7,559,677 | B1 | 7/2009 | Dupre | |
| 7,618,150 | B2 | 11/2009 | Chien | |
| 8,376,594 | B2 | 2/2013 | Park | |
| 8,523,383 | B1 | 9/2013 | Grigore | |
| 8,550,669 | B2 | 10/2013 | Macwan | |
| 8,820,985 | B1 | 9/2014 | Tam et al. | |
| 9,752,749 | B2 * | 9/2017 | Adams | F21V 5/04 |
| 2002/0064979 | A1 * | 5/2002 | Zakerzewski | F21S 8/06 439/110 |
| 2005/0254263 | A1 | 11/2005 | Harwood | |
| 2006/0262521 | A1 | 11/2006 | Piepgras et al. | |
| 2007/0285949 | A1 * | 12/2007 | Lodhie | F21S 8/038 362/648 |
| 2008/0247181 | A1 | 10/2008 | Dixon | |
| 2009/0168423 | A1 | 7/2009 | Miller | |
| 2009/0219717 | A1 * | 9/2009 | Feinbloom | F21V 14/06 362/240 |
| 2009/0244909 | A1 * | 10/2009 | Chen | F21V 19/0045 362/368 |
| 2010/0165607 | A1 | 7/2010 | Russo et al. | |
| 2012/0218777 | A1 * | 8/2012 | Que | F21V 19/004 362/612 |
| 2013/0058091 | A1 * | 3/2013 | Hast | F21V 17/162 362/249.04 |
| 2014/0218906 | A1 * | 8/2014 | Liu | F21V 21/30 362/220 |
| 2014/0355278 | A1 * | 12/2014 | Huang | F21S 8/036 362/427 |
| 2015/0159840 | A1 * | 6/2015 | Liu | F21V 21/35 362/648 |
| 2015/0250555 | A1 * | 9/2015 | Haverich | F21L 4/00 600/245 |
| 2016/0033099 | A1 * | 2/2016 | Bergman | F21S 8/061 362/236 |

OTHER PUBLICATIONS

Halo 3 in. White Recessed Lighting Housing; http://www.homedepot.com/p/Halo-3-in-White-Recessed-Lighting, 2003.

Focal Point, id-brand 4.5" aperture adjustable accent LED system brochure from www.focalpointlights.com.

Photograph of Wac Track Lighting Product on Houzz.com from a Google image search.

Photograph of Fixtures Track Lighting for Kitchen Small Kitchen from escorialdesign.com from a Google image search.

Beta-Calco, Xacara TR-brand track lighting brochure from www.betacalco.com, 2013.

European Search Report dated May 25, 2016, for corresponding European Patent Application No. 15172981.1.

Communication under Rule 71 (3) EPC from the European Patent Office concerning corresponding European Patent Application No. 15172981.

* cited by examiner

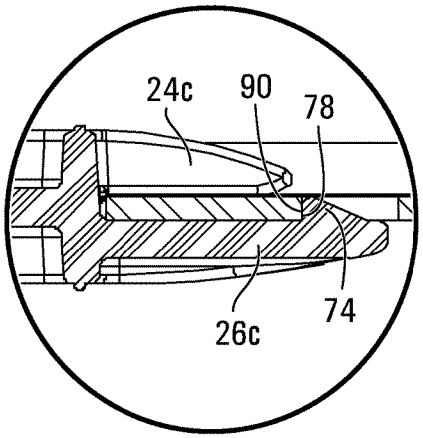
FIG. 13A
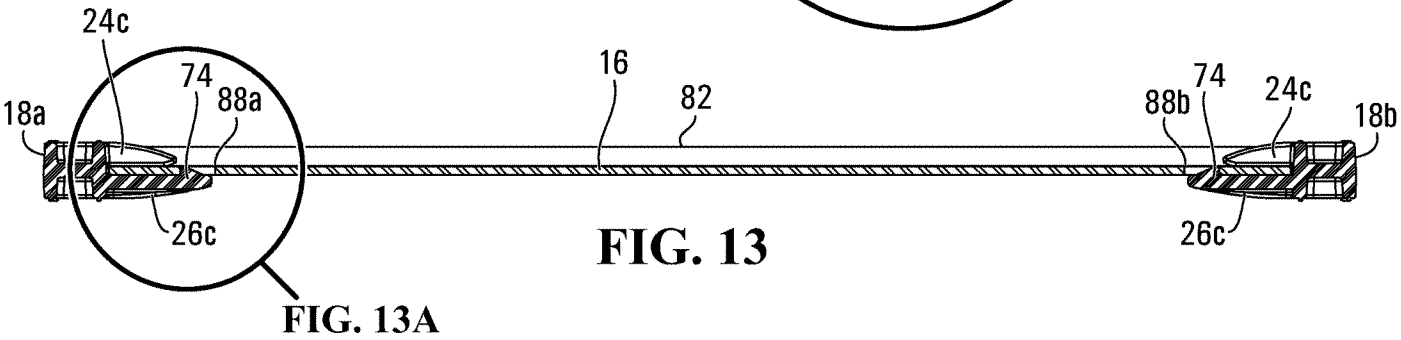
FIG. 13
FIG. 13A
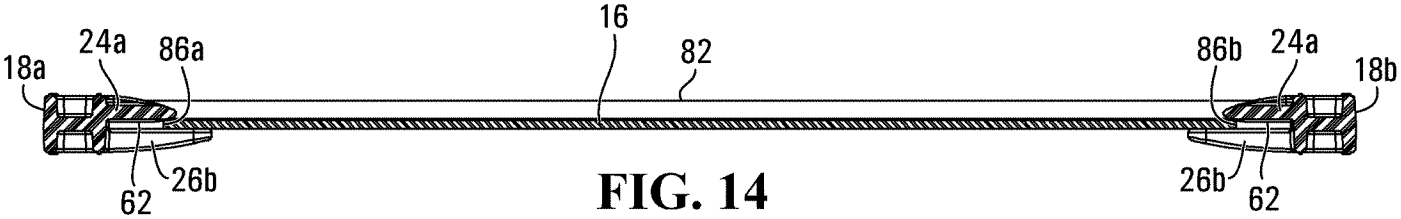
FIG. 14

RECESSED TRACK LIGHTING FIXTURE

FIELD

This invention relates generally to a recessed track lighting fixture.

BACKGROUND

Track lighting allows a user to position a luminaire at a desired position along a portion of a track that is attached, for instance, to a ceiling. In some applications, for instance in residential uses, one or more luminaires is supported by an exposed track. In other applications, for instance in commercial uses, one or more luminaires is supported by a track that has been fully or partially recessed into the ceiling. Thus, in many applications the luminaire and/or track might be visible to an observer. The visibility of the track and/or the visibility of portions of the luminaire may be undesirable. The track, if visible, may be considered an "eyesore" or otherwise aesthetically unappealing.

SUMMARY

Some embodiments disclosed herein provide for a recessed track lighting fixture comprising a first side member and a second side member, a linear support track defined between the first and second side members, a displacement member supported by the support track and displaceable along at least a portion of the support track, and a luminaire at least partially disposed between the first and second side members, the luminaire being supported by the displacement member and displaceable therewith.

In some embodiments, the support track includes a first channel connected to the first side member and a second channel connected to the second side member, and the displacement member includes first and second ends, wherein the first and second ends are slidably supported by the first and second channels, respectively.

In some embodiments, the first channel and the second channel face each other.

In some embodiments, each of the first and second side members have a first portion spaced apart from a second portion, the support track being defined between the first portions of the first and second side members.

In some embodiments, an illumination opening is defined between the second portions of the first and second side members.

In some embodiments, the luminaire is supported by the displacement member on a side of the displacement member facing the illumination opening.

In some embodiments, the recessed track lighting further comprises first and second sliding elements connected to the first and second end portions, respectively, the first and second sliding elements being received in first and second channels, respectively.

In some embodiments, the first and second sliding elements each comprise first and second pluralities of connectors for connecting the first and second sliding elements to the first and second end portions, respectively.

In some embodiments, a gap is provided between the first and second pluralities of connectors, one of the first and second ends being received in the gap.

In some embodiments, a connector of the pluralities of connectors includes a protrusion which is received in a corresponding aperture in one of the first and second ends.

In some embodiments, the first and second sliding elements comprise a thermoplastic or thermoset material.

In some embodiments, the first and second sliding elements comprise nylon.

In some embodiments, the recessed track lighting fixture is attached to a ceiling structure.

In some embodiments, the recessed track lighting fixture is attached to the ceiling structure via rods, tubes or cables.

In some embodiments, the luminaire is supported by the displacement member via an angular adjustment mechanism, the angular adjustment mechanism comprising positioning means and guiding means, one of the positioning means and the guiding means being coupled to the displacement member and the other of the positioning means and guiding means being coupled to the luminaire, the guiding means cooperating with the positioning means for positioning the luminaire at a desired angular position.

In some embodiments, the positioning means are coupled to the displacement member and include a positioning bracket, an arcuate slot defined in the positioning bracket and one or more positioning apertures defined in the positioning bracket parallel to the arcuate slot, each positioning aperture corresponding to one of the plurality of angular positions.

In some embodiments, the guiding means are coupled to the luminaire and include at least one pin for slidingly supporting the luminaire in the arcuate slot, and a positioning nub, the positioning nub being received by one of the one or more positioning apertures at the desired angular position.

In some embodiments, there is provided a recessed track lighting fixture comprising a housing and an angular adjustment mechanism for a luminaire. The angular adjustment mechanism comprises a support bracket coupled to the housing, the support bracket including an arcuate slot and a plurality of positioning apertures, each positioning aperture corresponding to a position along an arc, at least one pin coupled to the luminaire for slidingly supporting the luminaire in the arcuate slot, and at least one positioning nub coupled to the luminaire, wherein the at least one positioning nub is received by a corresponding number of the plurality of positioning apertures at a desired position along the arc.

In some embodiments, the at least one arcuate slot comprises two arcuate slots, the two arcuate slots being parallel and arranged on opposite sides of the luminaire.

In some embodiments, the at least one positioning nub comprises two positioning nubs.

In some embodiments, the housing comprises a first side member and a second side member, a linear support track defined between the first and second side members, and a displacement member supported by the support track and displaceable along at least a portion of the support track, wherein the luminaire is at least partially disposed between the first and second side members and the support bracket is supported by the displacement member and is displaceable therewith.

Other features and embodiments of the present disclosure will become apparent to those ordinarily skilled in the art upon review of the following description.

BRIEF DESCRIPTION OF THE DRAWINGS

Examples of embodiments of the invention will now be described in greater detail with reference to the accompanying drawings, in which:

FIG. 13 is a cross-sectional view of the displacement member of FIG. 8 taken along line A-A in FIG. 9;

FIG. 13A is an enlarged view of a portion of FIG. 13;

FIG. 14 is a cross-sectional view of the displacement member of FIG. 8 taken alone line B-B in FIG. 9;

DETAILED DESCRIPTION

In some embodiments of the invention, there is provided a recessed track lighting fixture having two opposing side members. A luminaire positioned between the side members is coupled to a displacement member, which in turn is displaceable along at least a portion of a linear support track defined between the side members.

In some embodiments, the linear support track includes two opposing channels. The displacement member includes a sliding element connected to either end of the displacement member, the sliding elements being slidingly disposed in the channels.

In some embodiments, the luminaire is coupled to the displacement member via an angular adjustment mechanism. The angular adjustment mechanism includes positioning means and guiding means. One of the positioning means and the guiding means is coupled to the displacement member and the other of the positioning means and guiding means is coupled to the luminaire. The guiding means cooperate with the positioning means for positioning the luminaire at a desired angular position.

Figure 1:
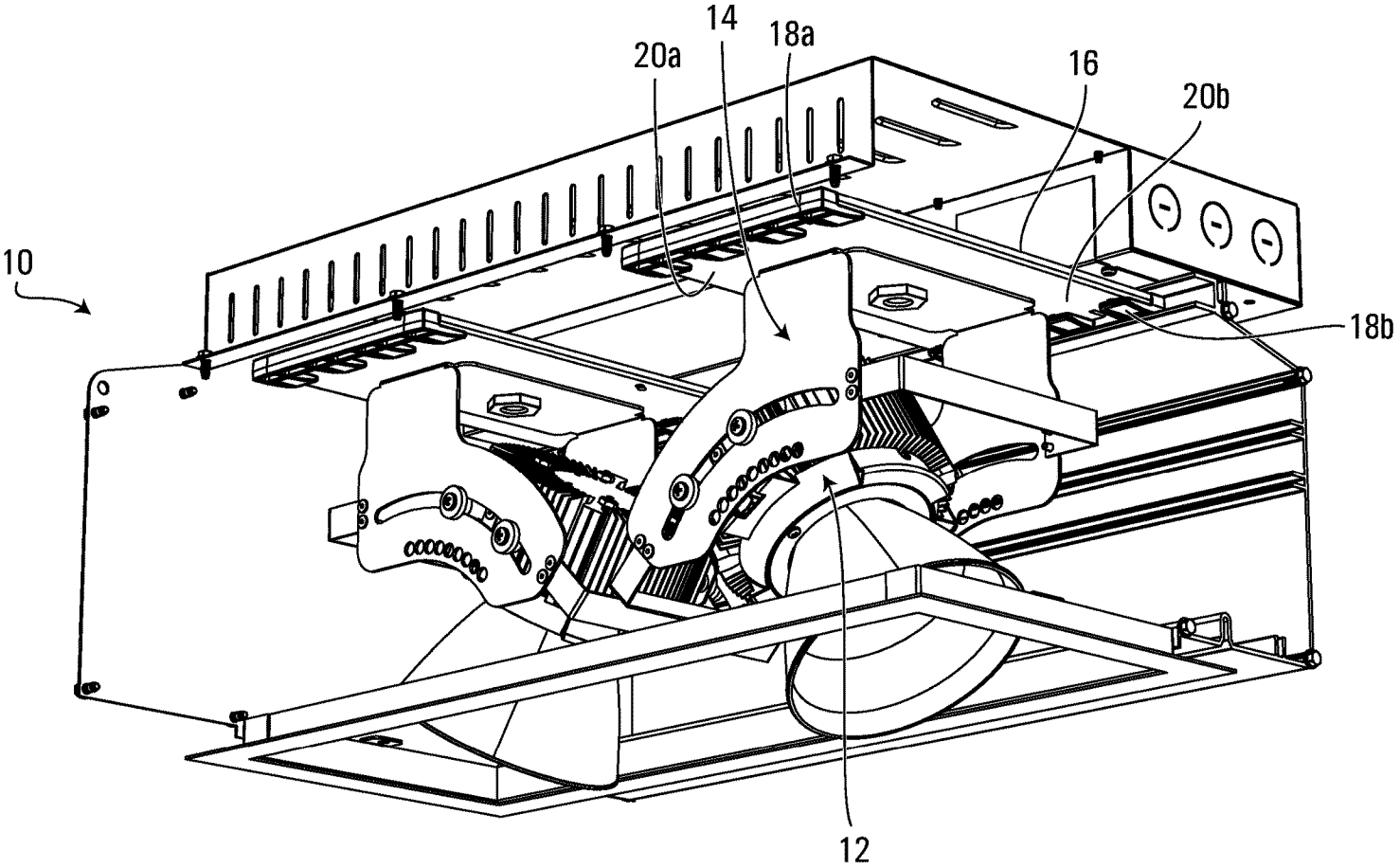
FIG. 1 is a perspective view of a recessed track lighting fixture according to an embodiment of the invention with an end and side panel removed.
Figure 2:
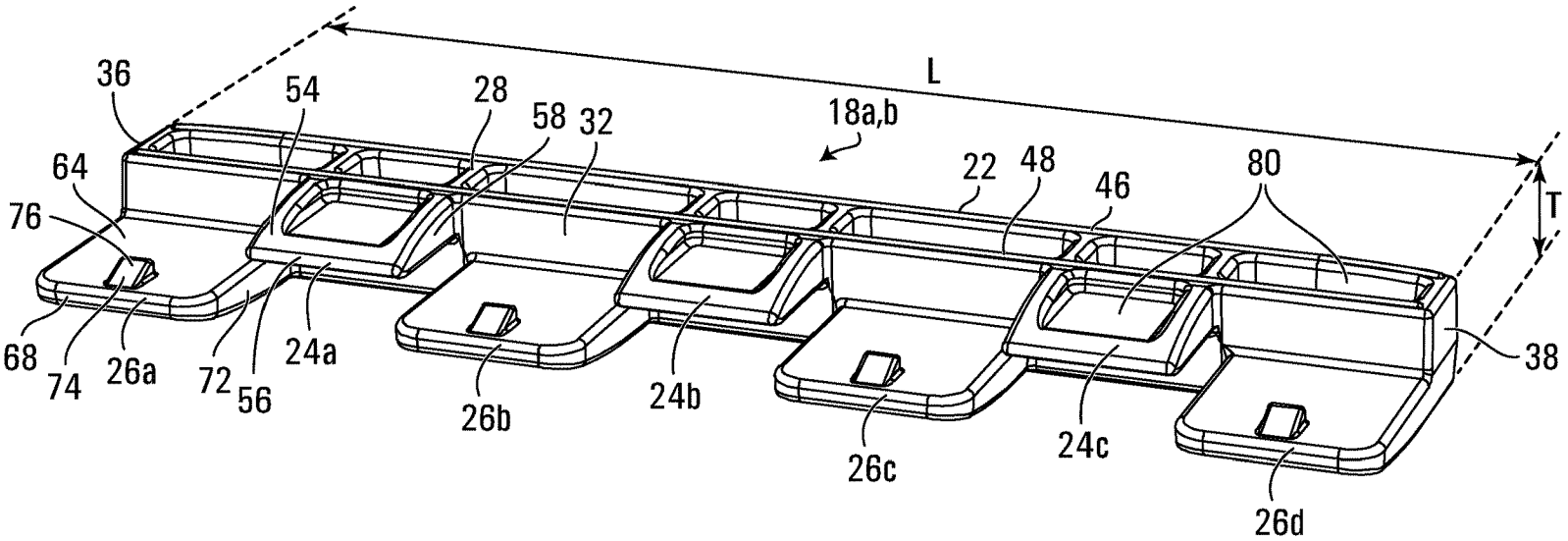
FIG. 2 is a perspective view of a sliding element of the recessed track lighting fixture of FIG. 1.
Figure 5:
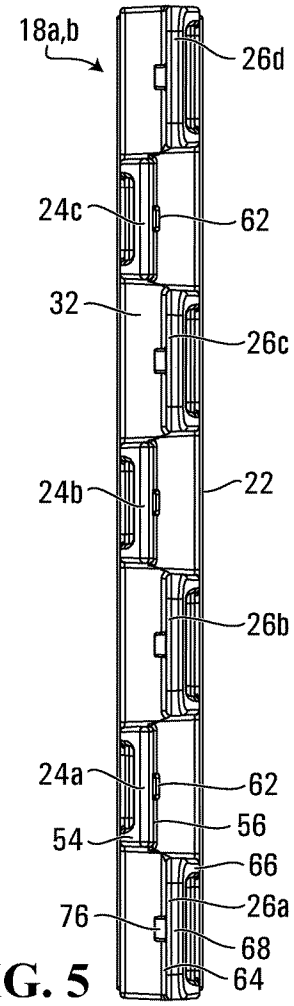
FIG. 5 is a right side view of the sliding element of FIG. 2.

FIG. 1 shows a recessed track lighting fixture according to an embodiment of the invention including a housing 10 for housing at least one luminaire 12 coupled via an angular adjustment mechanism 14 to a corresponding displacement member 16. First and second sliding elements 18*a* and 18*b* are connected to opposing first and second ends 20*a* and 20*b* of displacement member 16, respectively.

Referring now to FIGS. 2 to 7, an embodiment of the sliding elements 18*a*,18*b* will now be described. Each sliding element 18*a*,18*b* includes: a sliding element body 22, three wedge-shaped connectors or top claws 24*a*, 24*b*, 24*c*, and four wedge-shaped connectors or bottom claws 26*a*, 26*b*, 26*c*, and 26*d*.

The sliding element body 22 generally takes the shape of a rectangular prism having a top surface 28, a bottom surface 30, a first side surface 32, a second side surface 34 and first and second end surfaces 36 and 38. The distance between the end surfaces 36 and 38 is defined as length L of the sliding elements 18*a*,18*b* while the distance between the top and bottom surfaces 28 and 30 is defined as thickness T of the sliding elements 18*a*, 18*b* (see FIG. 2).

Figure 4:
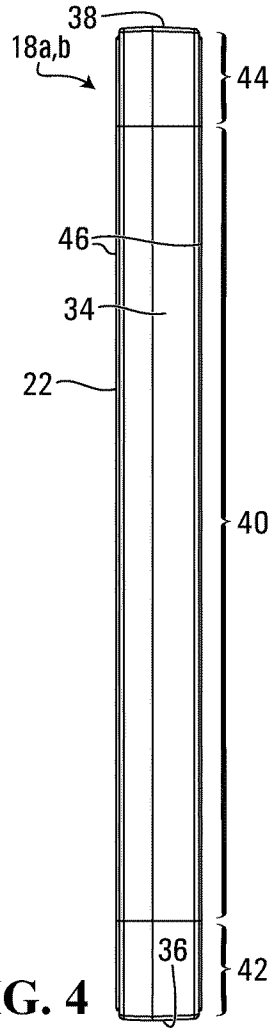
FIG. 4 is a left side view of the sliding element of FIG. 2.

As best seen in FIG. 4, the second side surface 34 is divided into three portions: a substantially flat, rectangular middle portion 40, and two curved end portions 42 and 44, which tangentially follow on from either end of the middle portion 40. The end portions 42 and 44 result in the second side surface 34 becoming convex on either end.

While in the embodiment shown the sliding element body 22 has the shape of a generally rectangular prism, other shapes for the sliding element body 22 are possible. Accordingly, the number, orientation and shape of the surfaces of the sliding element body as described herein may differ.

The sliding elements 18*a*, 18*b* also include first and second pairs of elevations 46 and 48 located on the top and bottom surfaces 28 and 30. The first and second pairs of elevations 46, 48 run substantially the entire length L of the sliding element body 22. The first pair of elevations 46 are parallel to each other and both run substantially parallel to the second side surface 34 along the top and bottom surfaces 28 and 30, respectively. Similarly, the second pair of elevations 48 are parallel to each other and both run substantially parallel to first side surface 32 along the top and bottom surfaces 28 and 30, respectively. The first pair of elevations 46 is located nearer to second side surface 34 than the second pair of elevations 48.

In the embodiment shown, the top claws 24*a* to 24*c* are spaced equally in a row along the length L and extend from the first side surface 32. The bottom claws 26*a* to 26*d* are spaced equally in a row along length L, also extend from the first side surface 32 and are spaced apart from the top claws 24*a* to 24*c* such that a gap 50 with a width W (see FIG. 6) is defined between the top and bottom claws.

Figure 3:
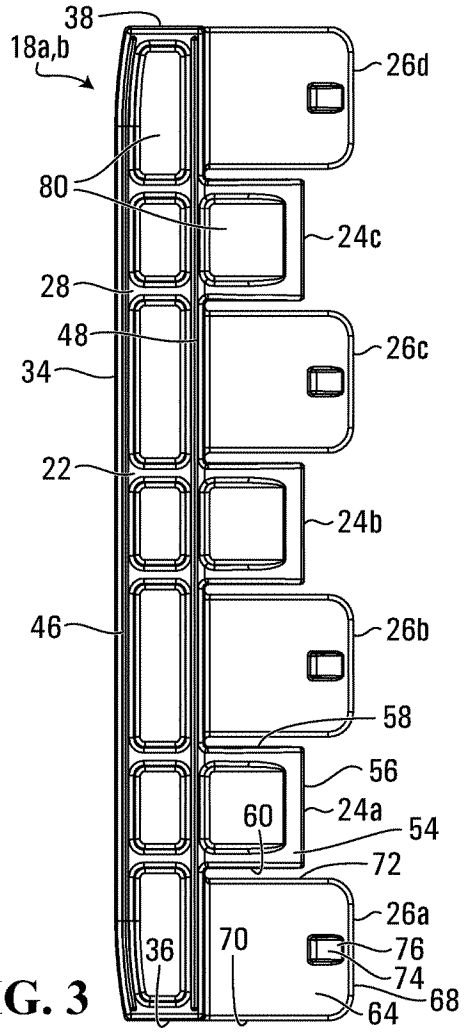
FIG. 3 is a top view of the sliding element of FIG. 2.
Figure 7:
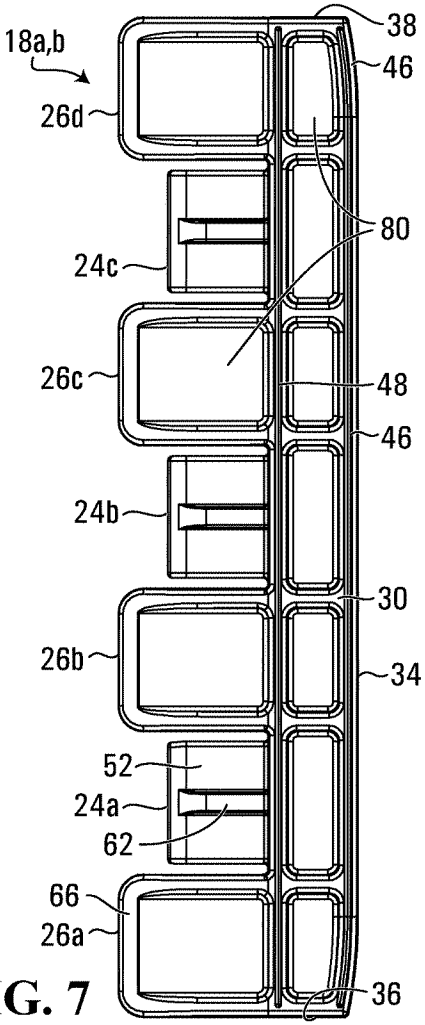
FIG. 7 is a bottom view of the sliding element of FIG. 2.

In this embodiment, each top claw 24*a* to 24*c* is wedge-shaped with a substantially flat undersurface 52, a curved upper surface 54 that meets the undersurface 52 at a rounded, beveled top claw leading edge 56 and two opposing generally triangular side surfaces 58 and 60 (see FIG. 3). The undersurface 52 and the upper surface 54 divergently extend from the top claw leading edge 56 to the sliding element body 22 where the upper surface 54 is substantially flush with the top surface 28 and where the undersurface 52 is substantially perpendicular to the first side surface 32 of the sliding element body 22. Similarly, the first and second side surfaces 58 and 60 of the top claws 24 are substantially perpendicular to the first side surface 32 of the sliding element body 22.

Each top claw 24*a* to 24*c* also includes an elongated protrusion 62, which extends from the first side surface 32 and ends before reaching the top claw leading edge 56. The protrusion 62 is positioned along approximately the centreline of the undersurface 52 and covers at least a portion of the undersurface 52.

In the embodiment shown, each bottom claw 26*a* to 26*d* is also wedge-shaped with a substantially flat upper surface 64, a curved undersurface 66 that meets the upper surface 64 at a rounded, beveled bottom claw leading edge 68 and two opposing, generally triangular side surfaces 70 and 72. The upper surface 64 and the undersurface 66 divergently extend from the bottom claw leading edge 68 to the sliding element body 22 where the undersurface 66 is substantially flush with the bottom surface 30 of the sliding element body 22 and where the upper surface 64 is substantially perpendicular to the first side surface 32 of the sliding element body 22. The side surfaces 70 and 72 are substantially parallel to the first and second end surfaces 36 and 38 of the sliding element body 22.

Each bottom claw 26*a* to 26*d* also includes a protrusion 74 protruding from the upper surface 64. The protrusion 74 is also wedge-shaped with an angled surface 76 divergently extending from the upper surface 64 and a substantially flat back surface 78 that is substantially perpendicular to the upper surface 64. The protrusion 74 is positioned between the bottom claw leading edge 68 and the first side surface 32 and approximately equidistant from both side surfaces 70 and 72.

Figure 6:
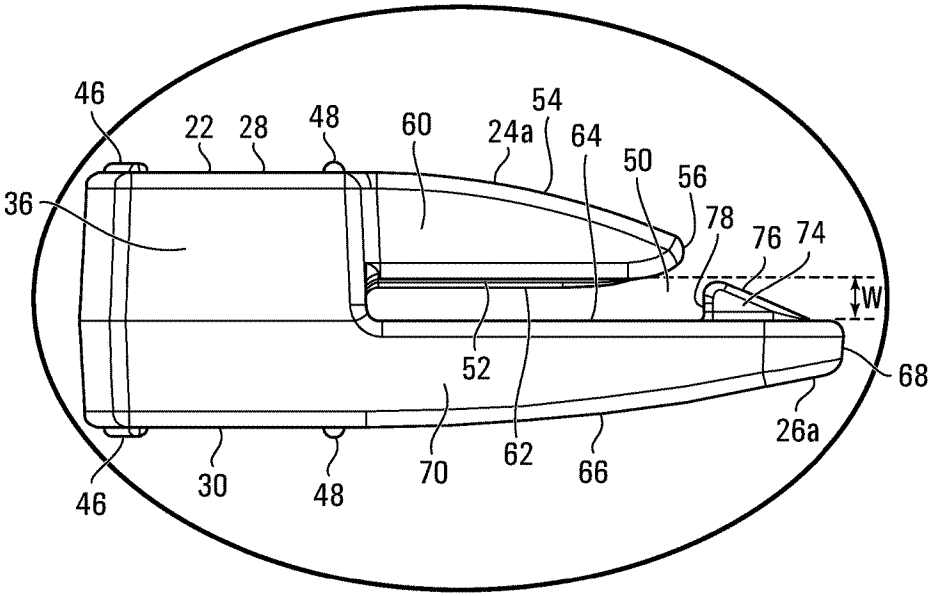
FIG. 6 is an enlarged front view of the sliding element of FIG. 2.
Figure 8:
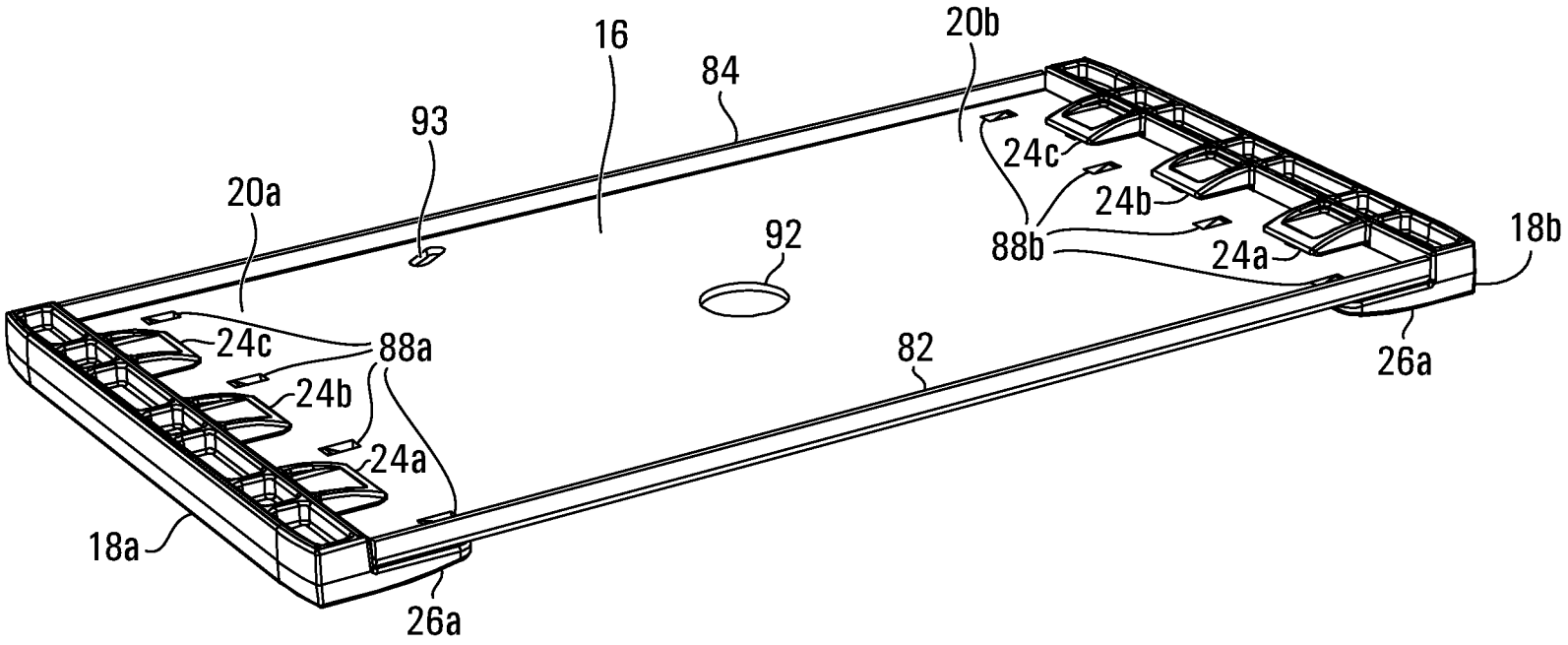
FIG. 8 is a perspective view of the displacement member of the recessed track lighting fixture of FIG. 1.
Figure 9:
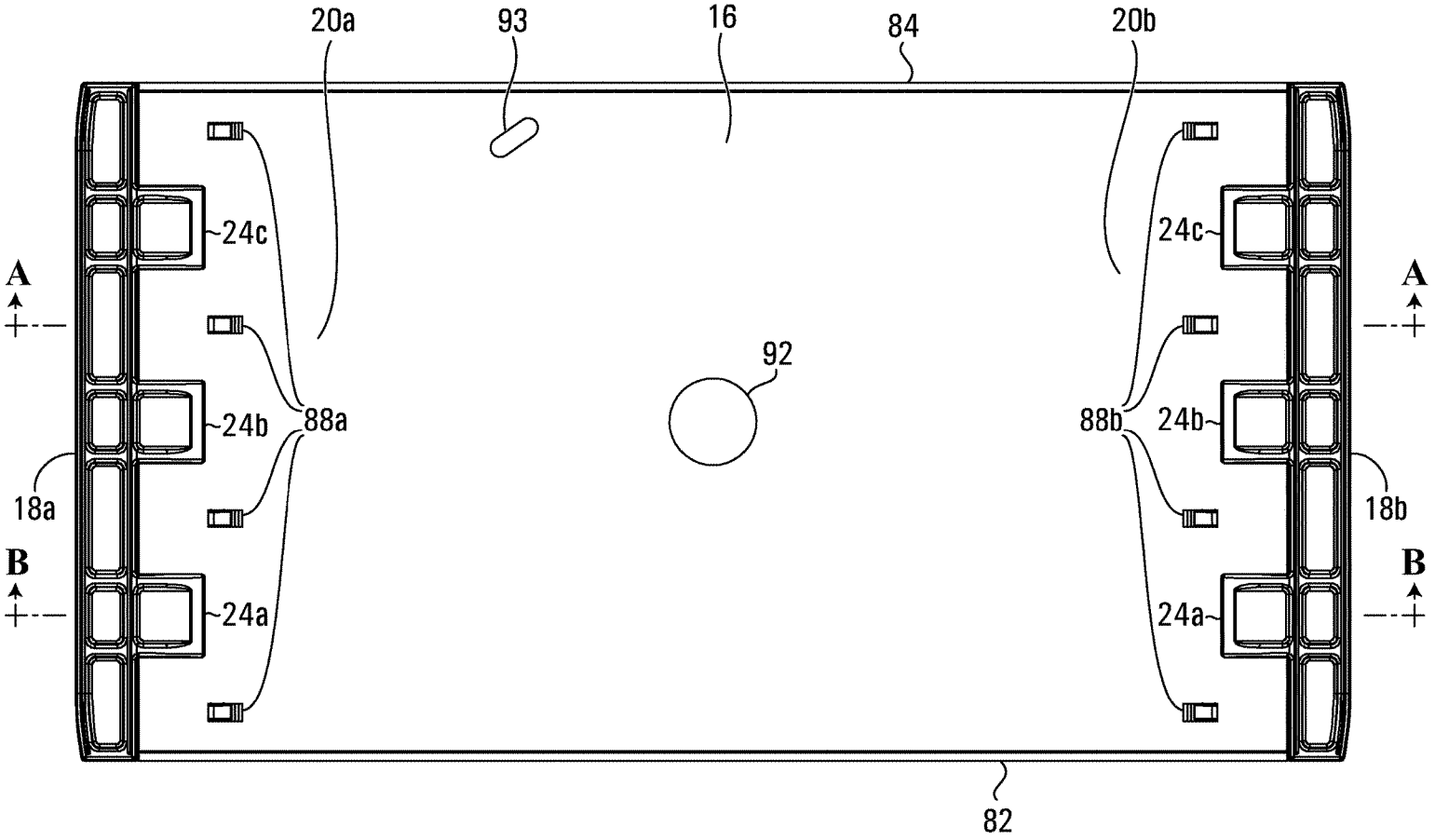
FIG. 9 is a top view of the displacement member of FIG. 8.
Figure 10:
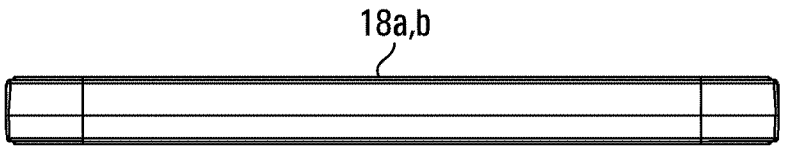
FIG. 10 is a right side view of the displacement member of FIG. 8, the left side view being the same.
Figure 11:
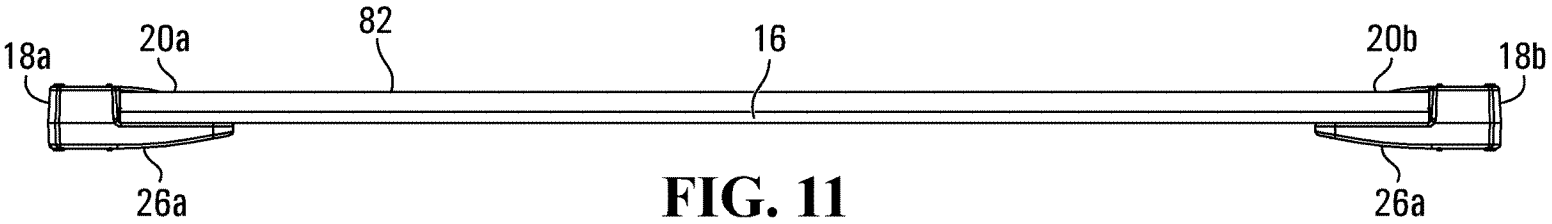
FIG. 11 is a front view of the displacement member of FIG. 8.
Figure 12:
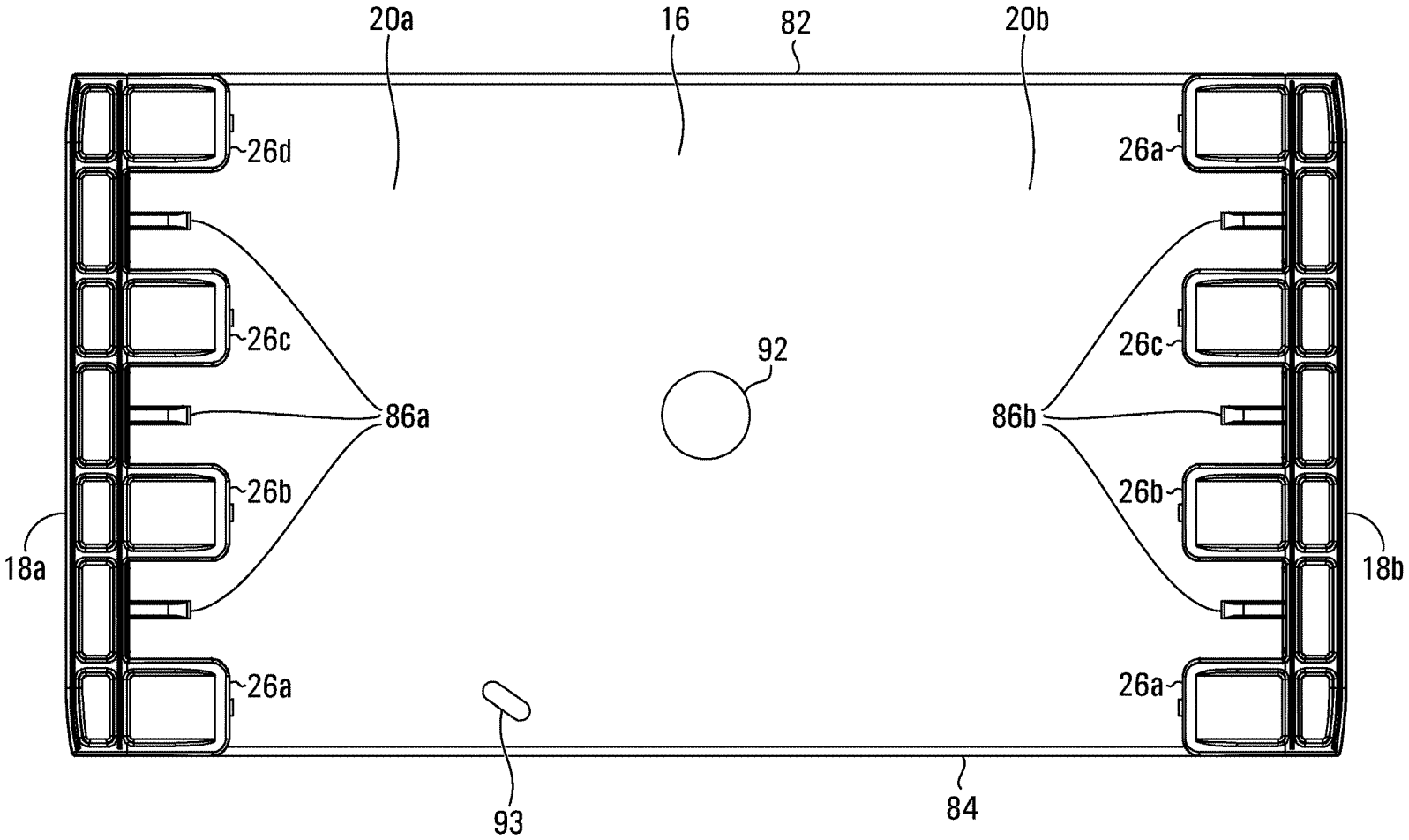
FIG. 12 is a bottom view of the displacement member of FIG. 8.
Figure 15:
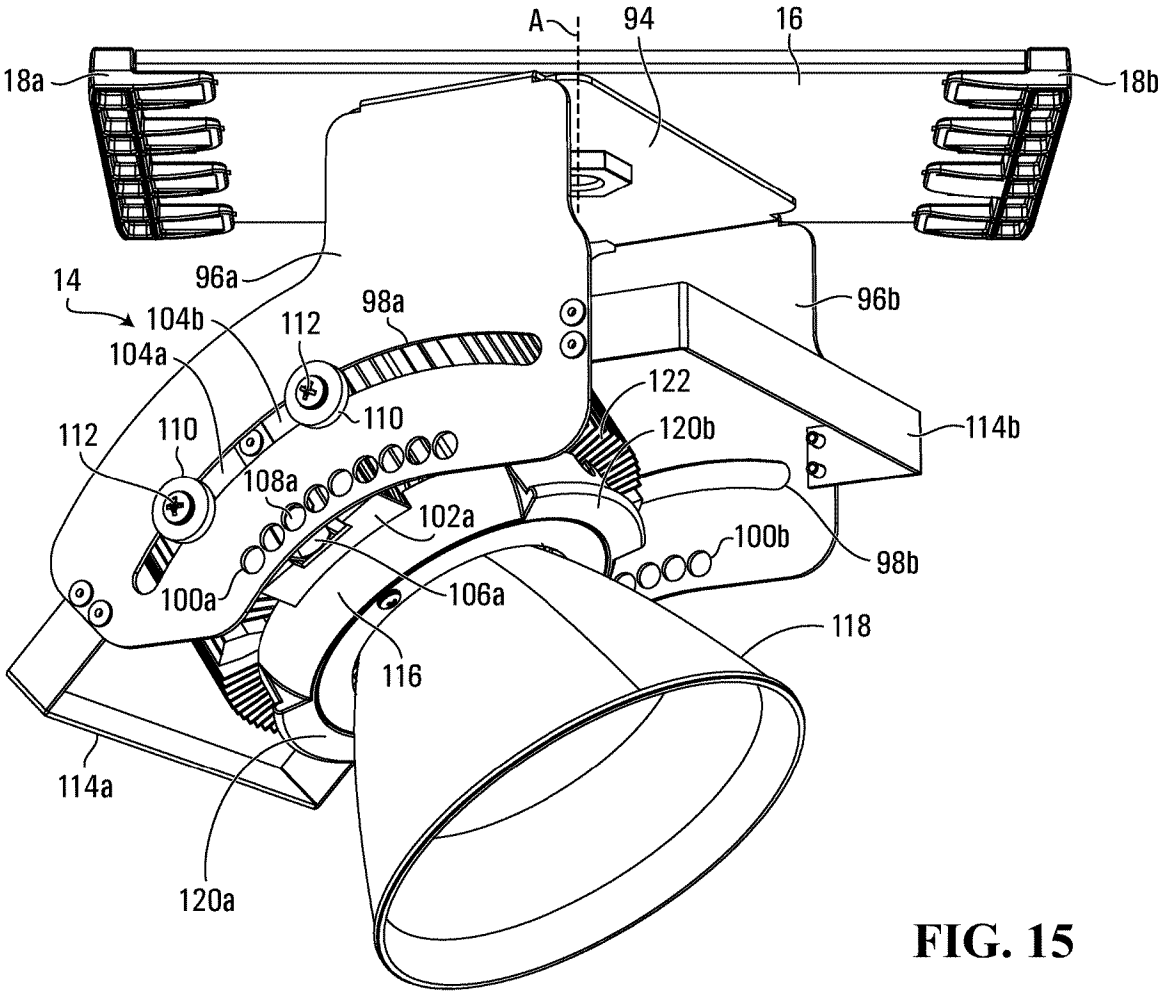
FIG. 15 is a perspective view of a luminaire of the recessed track lighting fixture of FIG. 1 coupled via an angular adjustment mechanism to a corresponding displacement member with connected sliding elements.

As seen best in FIG. 6, the bottom claw leading edge 68 is further from the sliding element body 22 than the top claw leading edge 56. Moreover, the back surface 78 is further from the sliding element body 22 than the top claw leading edge 56.

It is to be understood that the precise number, orientation, positioning and shape of the top claws 24 and the bottom claws 26 may differ from the embodiment shown and described herein. Furthermore, it is possible that in some embodiments one or more top claws differs in shape and/or size than the remaining top claws and that, similarly, one or more bottom claws has a different shape and/or size than the remaining bottom claws. The protrusions 62 and 74 may differ in shape and placement as well and may not be present in some embodiments. As discussed below, the shape, positioning and placement of the protrusions 62 and 74 is related to the connection of the sliding elements 18*a*, 18*b* to the displacement member 16 and, as such, may be varied according to the desired connection method.

In the embodiment shown, each sliding element 18*a*, 18*b* further includes a plurality of recesses 80 extending from the top and bottom surfaces 28 and 30, the upper surfaces 54 and the undersurfaces 66 into the sliding element body 22, top claws 24 and bottom claws 26. Including the recesses 80 may provide for a number of advantages. The recesses 80 may reduce the weight of the sliding element 18. They may also reduce the amount of material required to produce the sliding elements 18*a*, 18*b*, and therefore the cost of producing the sliding elements 18*a*, 18*b*. The recesses 80 may also improve the manufacturability of the sliding elements 18*a*, 18*b*. For instance if the sliding elements 18*a*,18*b* are molded, the recesses 80 may allow for more even cooling of the molded material.

It is to be understood that the recesses 80 are not necessarily present in every embodiment and may take on other shapes and be disposed in various locations, as desired and suitable.

The sliding elements 18*a*, 18*b* may be made of any suitable material including a thermoset or thermoplastic material, such as Nylon. Specifically, it may be desirable to produce the sliding elements 18*a*, 18*b* out of a material with a low coefficient of friction to improve slidability of the sliding elements 18*a*,18*b* with respect to the material of the housing 10. It may also be desirable to produce the sliding elements 18*a*, 18*b* out of a heat and expansion resistant material, specifically a material capable of withstanding the heat produced due to the operation of one or more of luminaires 12 without significant deformation, expansion or adverse effects to the desired properties of the sliding elements 18*a*, 18*b*.

The sliding elements 18*a*, 18*b* may be produced using a variety of known manufacturing methods. Specifically, the sliding elements 18*a*, 18*b* may be produced by moulding, such as by injection moulding.

While the features of the sliding elements 18*a*, 18*b* have been described with reference to the depicted embodiment, variations of the described features are possible. As noted above, the shape, size and configuration of the sliding element body may differ as well as the shape, configuration, size and placements of the top and the bottom claws. The sliding elements 18*a*,18*b* may be configured in a variety of suitable ways to allow the displacement member 16 to slide within the housing 10. As discussed below, because the shape of the sliding elements 18*a*, 18*b* is complementary to the track in which they slide, if the shape and configuration differs so too will the shape and configuration of the sliding elements 18*a*, 18*b*.

In yet other embodiments, the sliding elements 18*a*, 18*b* may be configured as roller or glider elements that include rollers, bushings or other means for displacing the elements and thus the displacement member 16 with respect to the housing 10.

Referring now to the embodiment shown in FIGS. 8 to 14, the displacement member 16 is generally shaped as a rectangular plate and is dimensioned so that the first and second ends 20*a*, 20*b* have substantially the same length L as the sliding element body 22 and so that the thickness of the displacement member 16 is substantially the same as the width W of the gap 50.

On opposing sides of the displacement member 16, lips 82 and 84 extend upward and are substantially the same height as the thickest portions of the top claws 24*a* to 24*c*. The lips 82 and 84 may provide stability and rigidity to the displacement member 16. This may aid in preventing the displacement member 16 from warping or bending due to, for instance, the weight of the luminaire 12.

In this embodiment, in order to connect the sliding elements 18*a*, 18*b* to the displacement member 16, the first and second ends 20*a*, 20*b* each include first and second sets of guiding apertures 86*a*, 86*b*, respectively, and first and second sets of connecting apertures 88*a* and 88*b*, respectively. Specifically, each aperture 86 receives a protrusion 62 from each top claw 24*a* to 24*c* and each aperture 88 receives a protrusion 74 from each bottom claw 26*a* to 26*d*.

The apertures 88*a* and 88*b* are positioned and sized such that when the protrusions 74 are received, each back surface 78 engages a corresponding engaging surface 90 inside each aperture 88 (see FIG. 13A). Furthermore, the apertures 88*a*, 88*b* are sufficiently spaced from the ends of the displacement member 16 such that the ends 20*a*, 20*b* engage the first side surfaces 32 of the first and second sliding elements 18*a* and 18*b*, respectively.

In this embodiment, the sliding elements 18*a*, 18*b* are connected to the displacement member 16, by guiding the sliding elements 18 onto their respective ends until the protrusions 74 are received in their respective apertures 88. In doing so, each protrusion 62 acts as a guide and is lined up with and received in its respective apertures 86. Because the thickness of the displacement member 16 matches the width W of the gap 50, when the sliding elements 18 are guided onto the displacement member 16, the protrusions 74 may interfere with the displacement member 16 before they are received in their respective apertures 88. The wedge shape of the protrusions 74 partially reduces this interference as the angled surface 76 slides along the displacement member 16.

To facilitate connection of the sliding elements 18 to the displacement member 16, the sliding elements 18 may be made of a resilient material that allows the bottom claws 26 to be temporarily flexed away from the displacement member 16, thereby reducing the interference between the protrusions 74 and the displacement member 16. Then, once the protrusions 74 are aligned with their respective apertures 88, the bottom claws 26 would return back to their original positions. Conversely, to remove the protrusions 74 from the apertures 88, the bottom claws 26 would need to be flexed away from the displacement member 16 until each back surface 78 clears and no longer engages with its respective engaging surface 90.

In this embodiment, the displacement member 16 also includes a central opening 92 for coupling the displacement member to the angular adjustment mechanism 14 as well as an elongated aperture 93 for mounting a screw to act as a stop when the angular adjustment mechanism 14 is rotated, as discussed further below.

The displacement member 16 may be made of any suitable material, including steel. In some embodiments, it may be desirable to produce the displacement member 16 of a material that has a high strength to weight ratio such that the displacement member 16 is suitably strong and also relatively light weight.

The displacement member 16 may be produced by a variety of known manufacturing methods, including by forming or by pressing.

While the features of the displacement member 16 have been described with reference to the depicted embodiment, variations of the described features are possible. For instance, the displacement member 16 may have any suitable shape and the sliding elements 18 may take on other shapes and configurations to suit the variation in shape and configuration of the displacement member 16. For instance, the displacement member 16 need not necessarily be a plate or plate-like.

In some embodiments, features of the displacement member such as the lips may be omitted. In some embodiments, the displacement member 16 may include holes and/or spaces in order to reduce the weight of the displacement member 16.

Furthermore, in some embodiments only one sliding member may be connected to the displacement member, or, in some embodiments, no sliding members are present at all with the displacement member 16 being disposed within the housing 10 without the presence of any sliding elements.

In some embodiments, the sliding elements may be integrally formed with the displacement member. In some embodiments, either or both of the top and bottom claws may not be present and the sliding elements 18*a*,18*b* may be connected to the displacement member 16 by other means such as with screws or with a nut and bolt arrangement. In some embodiments, the sliding elements, with or without top and/or bottom claws, may be fixed to the displacement member such as being glued in place without the use of protrusions 62 and 74 and corresponding guiding and connecting apertures 86 and 88.

Referring now to the embodiment as shown in FIGS. 15 to 19, the angular adjustment mechanism 14 includes a substantially rectangular, horizontal, plate-like central member 94 (see FIG. 15) and parallel, vertical, plate-like first and second side members 96*a* and 96*b*, which extend substantially perpendicularly from opposing ends of the central member 94 such that the luminaire 12 is positioned between them.

In this embodiment, the angular adjustment mechanism 14 also includes positioning means comprising arced slots 98*a*,98*b* in each of the side members 96*a*,96*b* respectively, both arced slots 98*a*,98*b* having the same predetermined radii of curvature, which depends on a variety of factors, including for instance, the range of angular adjustment desired and the size of the luminaire 12. The side members 96*a*, 96*b* also include first and second pluralities of circular positioning apertures 100*a*, 100*b*, respectively, that are arranged in an arced row substantially parallel to the slots 98*a*, 98*b*, each aperture 100 corresponding to a possible angular position of the luminaire 12.

In this embodiment, the angular adjustment mechanism 14 also includes guiding means which cooperate with the positioning means to allow a user to angularly position the luminaire 12. The guiding means include the first and second guide brackets 102*a*, 102*b*, each guide bracket 102*a*, 102*b* being positioned between the luminaire 12 and the corresponding side member 96*a*, 96*b*. Each guide bracket 102*a*, 102*b* includes a pair of spaced-apart arms 104*a*, 104*b*, respectively. On each guide bracket 102*a*, 102*b*, the arms 104*a*,104*b* branch out from a first common end, which is connected to the luminaire 12, and then re-connect again at a second common end (not visible).

First and second positioning tab 106*a*, 106*b* are arranged in the spaces between pairs of arms 104*a*, 104*b*, respectively. Each positioning tab 106*a*, 106*b* extends from the second common end, the free end of each positioning tab 106*a*, 106*b* being arranged adjacent to the plurality of positioning apertures 100*a*, 100*b*, respectively.

In the embodiment shown, first and second rounded positioning nubs 108*a*, 108*b* are arranged on the free ends of the positioning tabs 106*a*, 106*b*, respectively, each positioning nub 108*a*, 108*b* extending in the direction of the plurality of positioning apertures 100*a*, 100*b*, respectively. The positioning nubs 108*a*, 108*b* are sized to fully or partially mate with a corresponding one of the positioning apertures 100. The positioning tabs 106*a*, 106*b* are sufficiently flexible such that they may each be flexed or temporarily positioned away from the side members 96*a*, 96*b*, respectively, such that the nubs 108*a*, 108*b* disengage their corresponding positioning apertures 100.

In this embodiment, the angular adjustment mechanism 14 further includes pairs of pins (not visible) which extend from the guide brackets 102*a*, 102*b*. Each pair of pins extends from a guide bracket 102*a*, 102*b* through one of the slots 98*a*, 98*b*, respectively. A washer 110 is installed on either side of each pin using a screw 112. Thus, the pins each only have one degree of freedom, namely movement along the slots 98*a*, 98*b*.

The angular adjustment mechanism 14 also includes first and second U-shaped connecting brackets 114*a*, 114*b*. The connecting brackets 114*a*, 114*b* extend between and are connected to the side members 96*a*,96*b*, respectively. The brackets 114*a*, 114*b* may provide stability and rigidity to the angular adjustment mechanism by preventing side members 96*a*, 96*b* from warping or bending.

In the embodiment shown, the angular adjustment mechanism 14 is rotatably coupled to the displacement member 16 so that the mechanism 14, and thus the luminaire 12, can rotate with respect to the displacement member 16 around axis A. Specifically, a nut and bolt arrangement is provided which passes through the central opening 92 and a similar opening in central member 94 to enable rotational coupling of the luminaire 12 to the displacement member 16.

A screw may be mounted in the elongated aperture 93 to act as a stop so that the angular adjustment mechanism 14, and thus the luminaire 12, cannot be rotated more than 360 degrees about axis A. If a cable is used to supply power to the luminaire, the presence of a stop may aid in preventing the cable from becoming wrapped around the luminaire 12 and/or the adjustment mechanism 14. The presence of a stop may aid in preventing undesired tension or tugging on the cable due to a rotation of the luminaire 12 by more than one revolution. In some embodiments, additional stops may be mounted to the displacement member 16 or to other suitable locations in the housing 10 to limit the rotational movement of the angular adjustment mechanism 14 and/or the luminaire 12 as desired.

In this embodiment, in order to use the angular adjustment mechanism 14 to adjust the angle of luminaire 12, a user applies a sufficient force to the luminaire 12 to slide the pins along slots 98*a*, 98*b*. In doing so, each nub 108*a*, 108*b* disengages its respective positioning aperture 100 and the rounded shape of the nubs 108*a*, 108*b* acts as a cam, which flexes the tabs 106*a*, 106*b* away from their respective side member 96*a*, 96*b*. The user continues to apply the sufficient force until each nub 108*a*,108*b* aligns with and mates with a new respective positioning aperture 100 at a desired position.

It is to be understood that other means may be used to adjust the angular position of the luminaire 12. In particular, motorized, mechanized and/or electronic means may be included in the angular adjustment mechanism 14 to adjust the angular position of the luminaire 12. Such additional means to adjust the position of the luminaire 12 may also be controlled remotely or wirelessly to allow a user to adjust the position of the luminaire 12.

While the features of the angular adjustment mechanism 14 have been described with reference to the depicted embodiment, variations of the described features are possible. For instance, other means of rotatably coupling the angular adjustment mechanism 14 to the displacement member 16 are possible and known to a person skilled in the art. Alternatively, the angular adjustment mechanism 14 may be non-rotatably fixed to the displacement member 16.

The shape and configuration of the features of the angular adjustment mechanism 14 may also differ. For instance, the central member and side members may have other suitable shapes and configurations. There may be only one side bracket. Although nine positioning apertures are shown, there may be a different number of positioning apertures. The arced slots may have a different radius of curvature. Furthermore, the positioning apertures may not be circular and may take on a different shape corresponding with a different shape for the nubs. By adjusting these and other elements of the angular adjustment mechanism, various luminaires 12 may be accommodated and their range of adjustment may be varied. The angular adjustment mechanism 14 may also be configured so that the positioning means including the slots and positioning apertures are arranged on the luminaire 12, while the guiding means including the guide brackets, positioning tabs, nubs and pins are arranged on the respective the side members.

Furthermore, it is to be understood that the angular adjustment mechanism is not necessarily present in every embodiment so that the luminaire 12 could be directly coupled to the displacement member without the ability to adjust the luminaire's angular position.

In the embodiment shown, the luminaire 12 comprises a generally cylindrical body 116 to which conical reflector 118 is connected. In this embodiment, first and second handles 120*a*, 120*b* extend from the luminaire body 116 on opposite sides of the body 116 adjacent to reflector 118. The handles 120*a*, 120*b* provide a place for users to grip the luminaire 12 in order to adjust its position. The luminaire 12 may also include the heat sink 122 that circumferentially surrounds the body 116 adjacent to the handles 120*a*, 120*b* in order to dissipate heat produced by the luminaire 12 when in operation.

The luminaire 12 may be one of a variety of luminaires known to a person skilled in the art, for instance, a Light Emitting Diode (LED), High Intensity Discharge (HID) or fluorescent luminaire. It is to be understood that the angular adjustment mechanism and other features of the recessed track lighting fixture described herein can be varied to accommodate various luminaires.

The luminaire 12 may be powered by a variety of means known to a person skilled in the art, for instance, by a power cable (not shown) that connects to a power supply inside housing 10.

Figure 16:
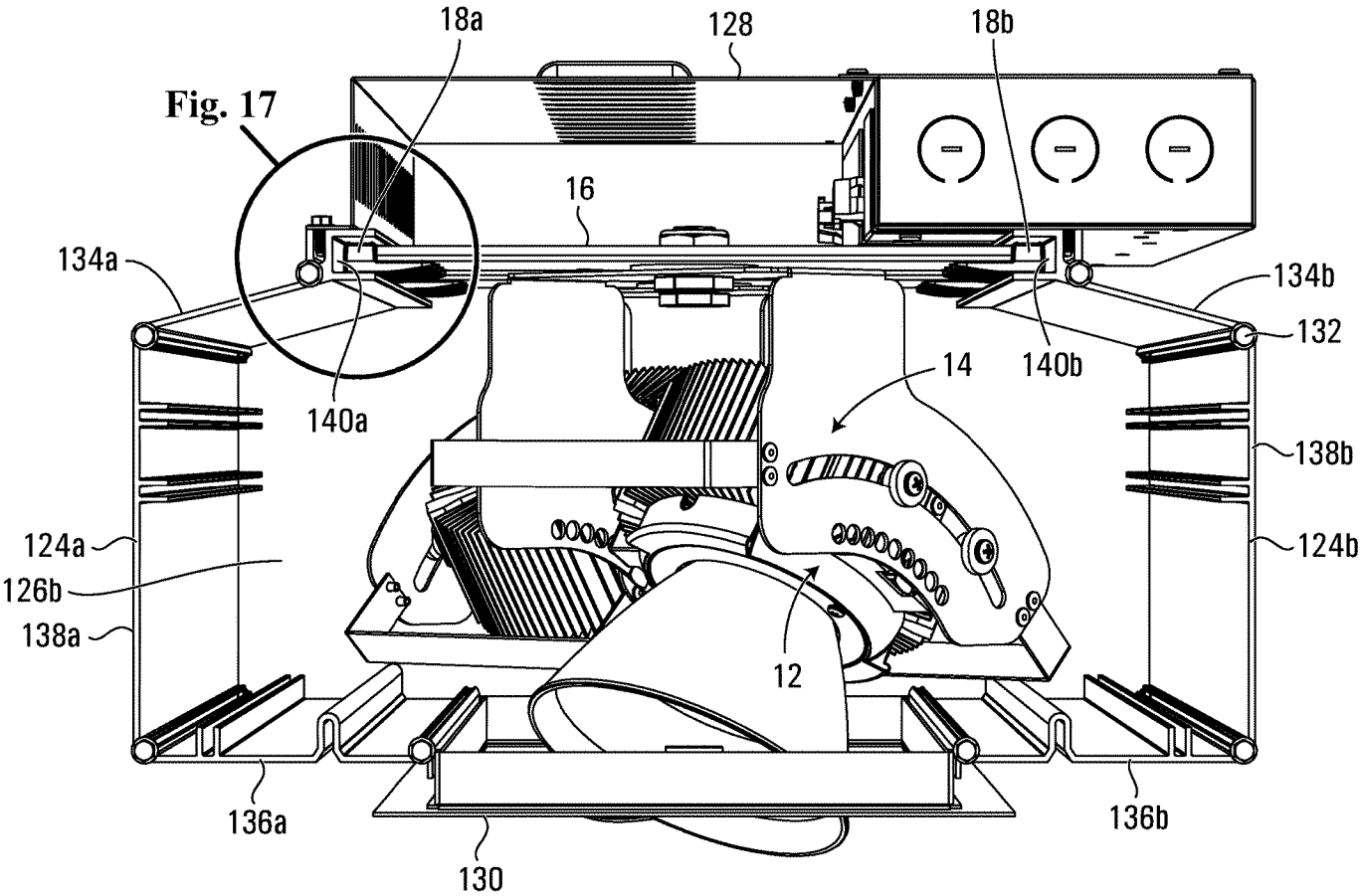
FIG. 16 is a front perspective view of the recessed track lighting fixture of FIG. 1 with an end panel removed.
Figure 18:
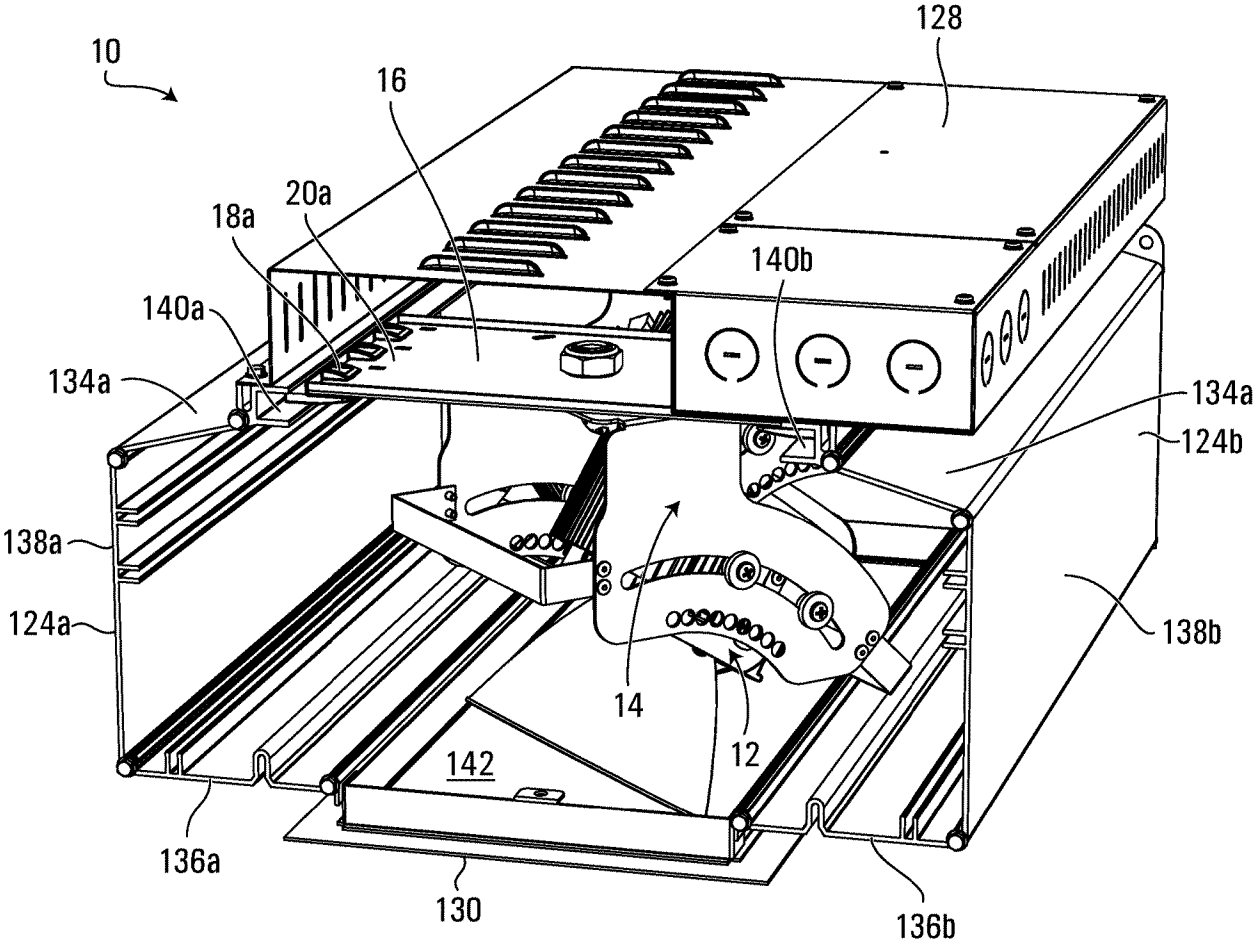
FIG. 18 is a top perspective view of the recessed track lighting fixture of FIG. 1 with an end panel removed.
Figure 19:
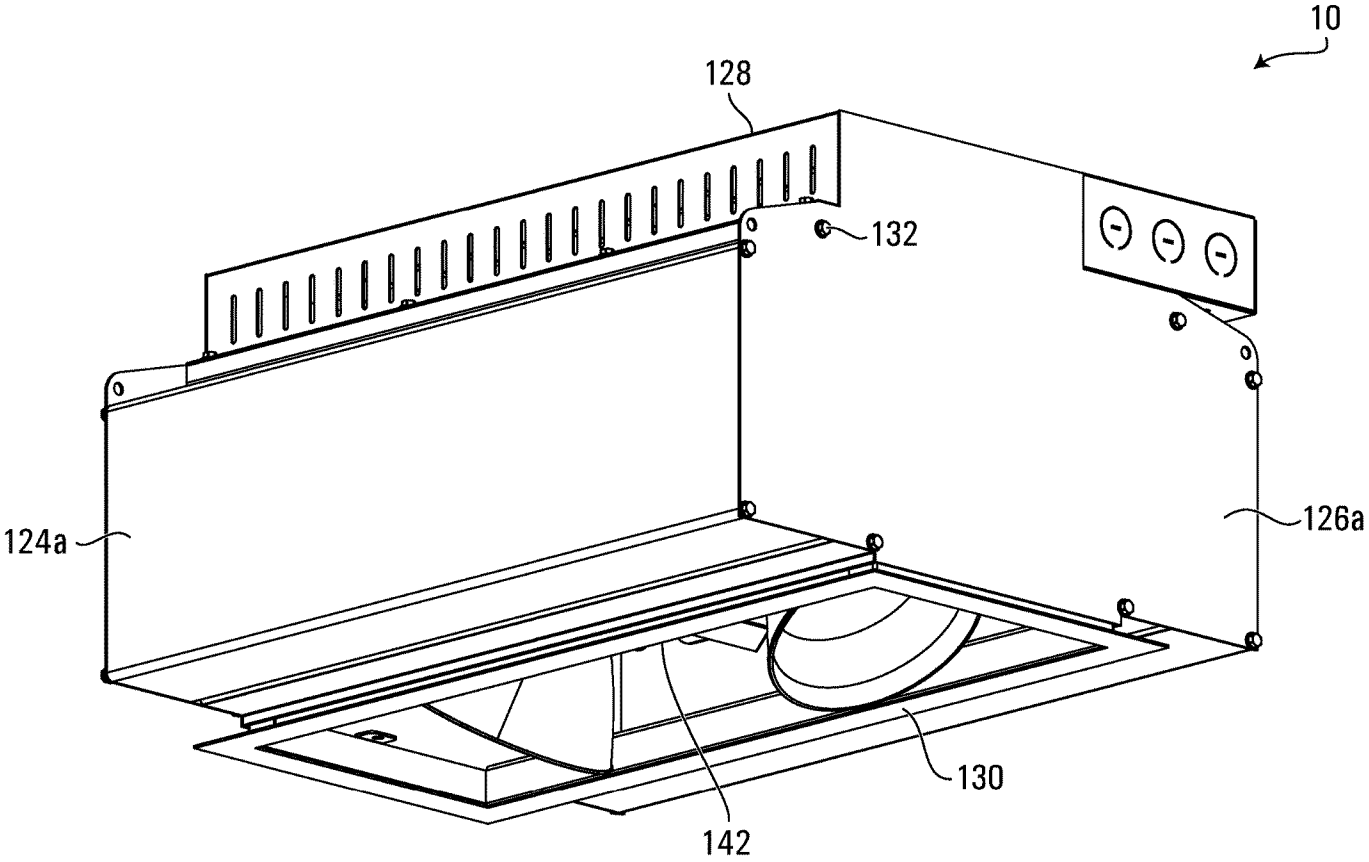
FIG. 19 is a perspective view of the recessed track lighting fixture of FIG. 1 with side and end panels in place.

As seen in FIGS. 16 and 18, the housing 10 includes first and second side members 124*a*, 124*b*, first and second end members 126*a*, 126*b*, top member 128, and frame member 130, which are fixed to one another using a plurality of screws 132.

The first and second side members 124*a*, 124*b* have substantially the same profile and are shaped to each have a first, angled portion 134*a*, 134*b* respectively, spaced apart from a second, substantially horizontal, bottom portion 136*a*, 136*b*, respectively. The first and second portions 134*a*, 134*b* and 136*a*, 136*b* are connected to the opposite ends of substantially vertical, intermediate portions 138*a*, 138*b*, respectively. The bottom portions 136*a*, 136*b* are connected substantially perpendicularly to the bottom edge of their respective intermediate portions 138*a*, 138*b*, while the angled portions 134*a*, 134*b* extend at an obtuse angle from the upper edge of their respective intermediate portions 138*a*, 138*b*.

Opposing, parallel C-shaped first and second channels 140*a*, 140*b* are connected to the first and second upper portions 134*a*, 134*b*, respectively, at the ends of the first and second upper portions 134*a*, 134*b* opposite intermediate portions 138*a*, 138*b*.

Figure 17:
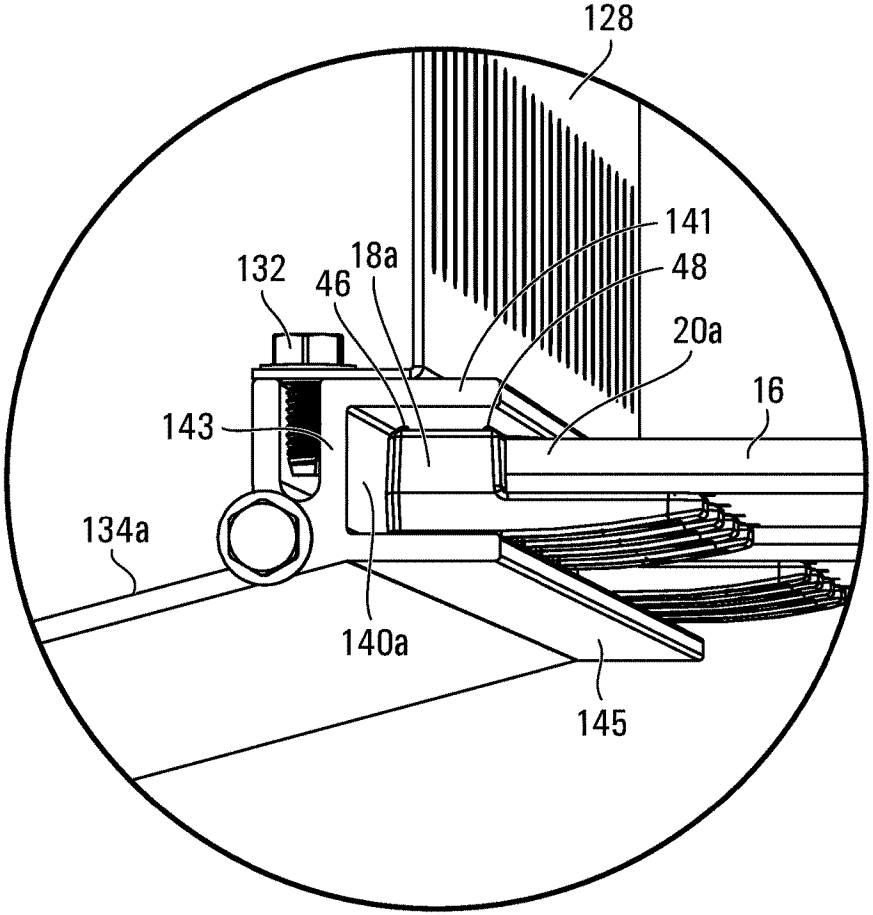
FIG. 17 is an enlarged view of a portion of FIG. 16.

As best seen in FIG. 17, each of the first and second channels 140*a*, 140*b* includes a top channel portion 141, a side channel portion 143 and a bottom channel portion 145, which together form the "C" shape of the first and second channels 140*a*, 140*b*. Each channel portion has a substantially rectangular cross-section and extends the length of the first and second channels 140*a*, 140*b*. The interior surface of each channel 140*a*, 140*b* is comprised of the faces of the top, side and bottom channel portions 141, 143, and 145 that face into the interior of the channels 140*a*, 140*b*. In the embodiment shown, the top and bottom channel portions 141, 145 are substantially parallel and horizontal, while the side channel portion 143 is substantially vertical and meets the other two channel portions at an approximately 90 degree angle.

In the embodiment shown, beside the side channel portions 143, screw holes are provided for connecting top member 128 to the first and second side members 124*a*, 124*b* using screws 132.

The displacement member 16 is displaceable within a linear support track defined between the first and second side members 124*a*, 124*b*, specifically, between the first and second upper portions 134*a*, 134*b*.

More specifically, in the embodiment shown, the displacement member 16 is disposed in the first and second channels 140*a*, 140*b*, which are spaced apart and act as rails of the support track permitting the displacement member 16 to slide along at least a portion of their length.

In the embodiment shown in FIG. 17, the shape of the first and second channels 140*a*, 140*b* is complementary to a portion of the cross-section of the sliding element body 22 and at least partially mates with it. The first and second pairs of elevations 46 and 48 of sliding element body 22 contact the interior of the channel at the top and bottom channel portions 141 and 145 and the middle portion 40 of the second side surface 34 (not visible in FIG. 17) of the sliding element body 22 contacts the interior of the channel at the side channel portion 143. The displacement member 16 is provided with one degree of freedom within the linear support track, namely movement along at least a portion of the length of the linear support track.

Some of the features of the sliding element body 22 described above better permit it to slide in the channels 140*a*, 140*b*.

Specifically, the curvature of the second side surface 34 better permits the sliding element body 22 to slide freely within the channels 140*a*, 140*b* because the edges formed at the intersection of side surface 34 and end surfaces 36 and 38 of the sliding element body 22 do not contact the interior faces of the channels 140*a*, 140*b* at the side channel portions 143 and therefore do not interfere with the sliding of the sliding element body 22. Moreover, in the embodiment shown, the transition from curved end portions 42 and 44 to middle portion 40 of the sliding element body 22 is substantially tangential in order to avoid presenting an edge that could interfere with the sliding movement of the sliding element body 22.

Furthermore, the first and second pairs of elevations 46 and 48 may aid in reducing friction between the sliding element body 22 and the channels 140*a*, 140*b* by reducing the contact surface area between the sliding element body 22 and the upper and lower faces of the interior of the channels 140*a*, 140*b*.

Moreover, the combination of materials used for the sliding elements 18*a*, 18*b* and the first and second channels 140*a*, 140*b* may facilitate the movement, specifically the sliding, of the displacement member 16 within the channels. A suitable combination of materials, for instance, may include Nylon sliding elements 18*a*, 18*b* and steel or aluminum channels 140*a*, 140*b*. However, other combination of complementary materials with suitable structural properties may be possible. Furthermore, additional lubricating agents may be employed to facilitate relative movement, specifically sliding, between the sliding elements 18*a*, 18*b* and the channels 140*a*, 140*b*. For instance, if a polymer or combination of polymers is used for either or both of the sliding elements 18*a*, 18*b* and the channels 140*a*, 140*b*, the polymer or combination of polymers may be impregnated with a lubricant. A lubricant or other non-stick coating, such as TEFLON®, may also be applied to the surface of either or both of the sliding elements 18*a*, 18*b* and the channels 140*a*, 140*b*.

It is to be understood that the features of the support track are not limited to the features described herein and shown in the embodiment of the FIGS. For instance, the linear support track need not necessarily comprise opposing C-shaped channels. The support track may be configured as a flat surface on which the displacement member or the sliding elements rest but can be lifted off of.

In some embodiments, the support track and the displacement member may also include other means which cooperate to allow the displacement member to be displaced along the support track. For instance, the support track may include rails, which support corresponding rollers coupled to the displacement member or sliding elements 18*a*, 18*b*. However, other means may also be known to the person skilled in the art, for instance the use of bushings, gliding elements, or a magnetic track. Moreover, the sliding elements are not necessarily present in every embodiment and in some embodiments it is possible for displacement member to be configured so that the first and second end portions are received by the support track directly within the housing, for instance in the respective channels, if present.

In some embodiments, the rails of the linear support track may be provided on the displacement member. For instance, the first and second channels may be provided facing away from each other on the first and second ends of the displacement member and may receive a corresponding, complementary plate-like structure provided on the housing.

The generally rectangular frame member 130 is arranged between the first and second bottom portions 136*a*, 136*b* and the first and second end members 126*a*, 126*b*. The frame member 130 defines an illumination opening 142.

As shown, the luminaire 12 may be directed towards the illumination opening 142 and is arranged on the side of the displacement member 16 facing the illumination opening 142.

In this embodiment, to laterally position the luminaire 12 along the support track, a user applies a sufficient force to the displacement member 16 to slide sliding elements 18*a*, 18*b* within the channels 140*a*, 140*b*, respectively. The force may be applied to the luminaire 12, for example by using the handles 120*a*, 120*b*. Alternatively, the force may be applied to a different component, such as one of the first and second connecting brackets 114*a*, 114*b*, if present, or directly to the displacement member 16. Similarly, to rotate the luminaire 12 around axis A, a user may apply a rotational force to the luminaire 12. For example, this may be accomplished using the handles 120*a*, 120*b*. Alternatively, the force may be applied to other components, such as one of the first and second connecting brackets 114*a*, 114*b*. Furthermore, to adjust the angular position of the luminaire 12 using the angular adjustment mechanism 14, a user may apply a sufficient force to the luminaire 12, including using the handles 120*a*, 120*b* or the first and second connecting brackets 114*a*, 114*b*.

It is to be understood that the luminaire 12 may be positioned laterally by other means such as by a servo-motor or other motorized, mechanized or electronic means included within or exterior to the housing 10. Such additional means to adjust the position of the luminaire 12 may also be controlled remotely or wirelessly to allow a user to adjust the position of the luminaire 12. The position of the luminaire 12 may be adjusted upon installation of the housing 10 or at a later time, i.e. during use and after installation.

The housing 10 may be installed in a ceiling structure so that the members comprising housing 10, other than the frame member 130, are hidden behind the ceiling when viewed by an observer underneath the ceiling. Alternatively, the housing 10 may be installed such that all members, including the frame member 130, are hidden and a user is only able to see through the illumination opening 142.

Alternatively, the housing 10 may also be installed in a wall structure or other structure. In some embodiments, when the housing 10 is installed in a wall, a portion of the luminaire 12, such as the reflector 118 may pass through the illumination opening 142. In other embodiments, no portion of the luminaire 12 passes through the illumination opening 142.

The housing 10 may be installed in a ceiling structure using known methods including via steel rods, tubes or cables mounted from the ceiling structure to the housing 10. Furthermore, in some embodiments, the housing 10 may be mounted as a pendant below a ceiling either as is or inside a decorative box.

Due to the combination of features of the recessed track lighting fixture described above, when the housing 10 is installed in a ceiling or wall structure, a user may position the luminaire 12 as desired within a predetermined range of motion and along multiple degrees of freedom. Specifically, the luminaire 12 may be positioned by a combination of one or more of displacing the displacement member 16 along a portion of the support track, rotating the luminaire 12 with respect to the displacement member 16 and adjusting the angular position of the luminaire 12 using the angular adjustment mechanism 14.

Figure 20:
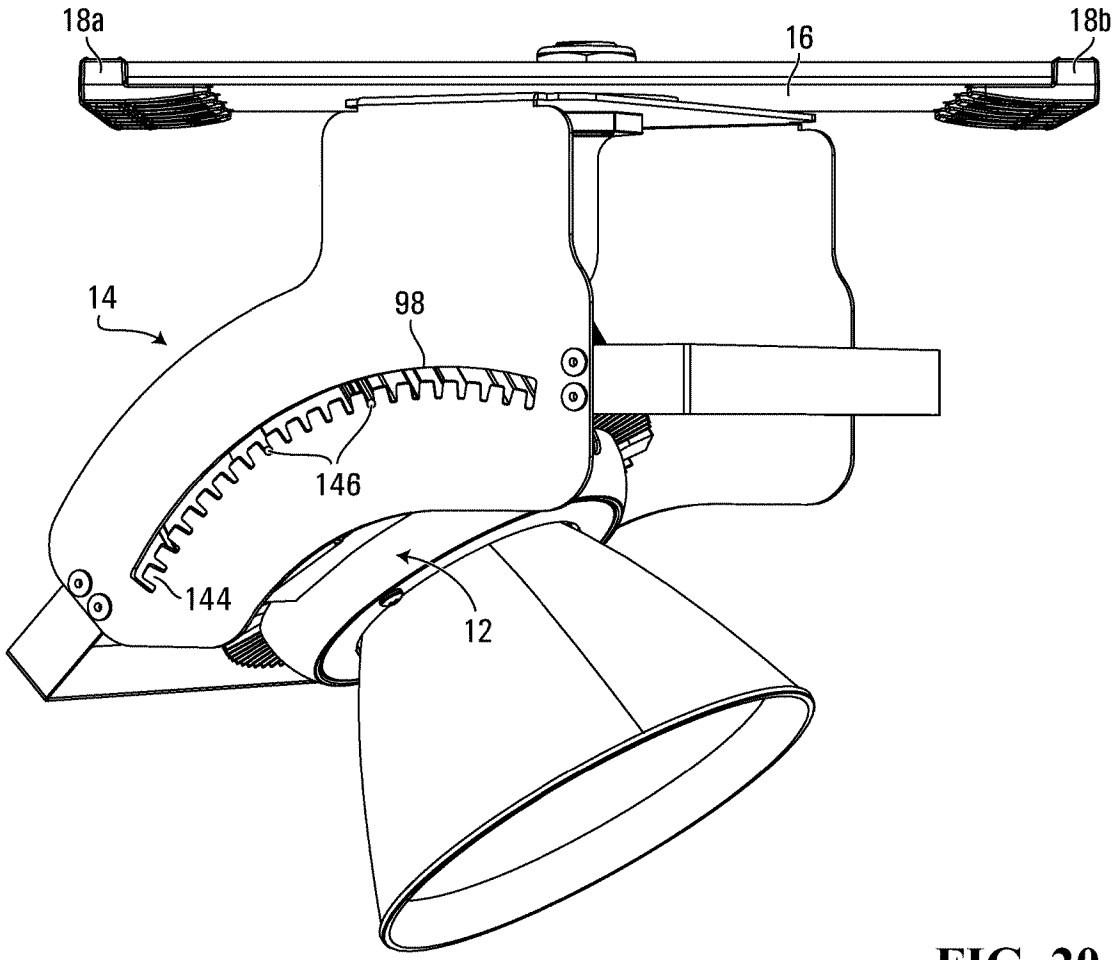
FIG. 20 is a perspective view of a luminaire coupled to a displacement member with connected sliding elements via an angular adjustment mechanism according to a second embodiment of the invention.

It is understood that variations of the above described embodiments are possible. For instance, a further embodiment of an angular adjustment mechanism according to the invention is shown in FIG. 20. In this further embodiment, each arced slot 98 (second slot not visible) comprises a plurality of teeth 144, extending along one edge of the slot. Pins 146 extend through their respective slots, which are received in the spaces between the teeth 144.

In order to adjust the angle of the luminaire 12, a user would first lift the luminaire 12 so that the guides disengage from the spaces between the teeth 144. Then, the user would adjust the angle of the luminaire 12 by sliding the pins along their respective slots 98 until they line up with new respective spaces at the desired position. The luminaire 12 would then be lowered so that the pins are received by their new respective spaces and the luminaire is supported at the desired position.

The components described above may be constructed, machined, formed and manufactured using a variety of techniques and materials known to a person skilled in the art.

Furthermore, although illustrative embodiments are described above and shown in the drawings, other variations, modifications and improvements may be possible and are included within the scope of the present disclosure.

The invention claimed is:

1. A recessed track lighting fixture comprising:

a first side member and a second side member, a linear support track defined between the first and second side members, a displacement member supported by the support track and displaceable along at least a portion of the support track in a displacement direction, and a luminaire at least partially disposed between the first and second side members, the luminaire being supported by the displacement member and displaceable therewith;

wherein the support track includes a first channel connected to the first side member and a second channel connected to the second side member, the first and second channels extending in the displacement direction;

wherein the displacement member includes first and second supporting portions;

wherein first and second sliding elements are connected to the first and second supporting portions, respectively;

wherein the first and second sliding elements are received in the first and second channels, respectively, and remain in contact with the channels during displacement; and wherein the first and second sliding elements each comprise first and second pluralities of connectors for connecting the first and second sliding elements to the first and second supporting portions, respectively.

2. The recessed track lighting fixture of claim 1, wherein the first channel and the second channel face each other.

3. The recessed track lighting fixture of claim 1, each of the first and second side members having a first portion spaced apart from a second portion, the support track being defined between the first portions of the first and second side members.

4. The recessed track lighting fixture of claim 1, wherein the first and second supporting portions are first and second ends of the displacement member, respectively.

5. The recessed track lighting fixture of claim 1, a gap being provided between the first and second pluralities of connectors, one of the first and second supporting portions being received in the gap.

6. The recessed track lighting fixture of claim 1, a connector of the pluralities of connectors including a protrusion which is received in a corresponding aperture in one of the first and second supporting portions.

7. The recessed track lighting fixture of claim 1, the first and second sliding elements comprising a thermoplastic or thermoset material.

8. The recessed track lighting fixture of claim 1, wherein the recessed track lighting fixture is attached to a ceiling structure.

9. The recessed track lighting fixture of claim 1, the luminaire being supported by the displacement member via an angular adjustment mechanism, the angular adjustment mechanism comprising:

positioning means and guiding means, one of the positioning means and the guiding means being coupled to the displacement member and the other of the positioning means and the guiding means being coupled to the luminaire, the guiding means cooperating with the positioning means for positioning the luminaire at a desired angular position.

10. The recessed track lighting fixture of claim 1, further comprising a pivoting mechanism associated with the luminaire.

11. The recessed track lighting fixture of claim 1, wherein the first channel comprises a first horizontal surface and the second channel comprises a second horizontal surface and at least a portion of the first sliding element rests on the first horizontal surface and at least a portion of the second sliding element rests on the second horizontal surface.

12. The recessed track lighting fixture of claim 1, wherein the first and second channels each have a cross-sectional profile that is complementary to a cross-sectional shape of at least a part of the first and second sliding elements, respectively.

13. The recessed track lighting fixture of claim 1, wherein the first and second channels are structured and arranged to constrain movement of the displacement member perpendicular to the displacement direction.

14. The recessed track lighting fixture of claim 1, wherein, during displacement along the support track, the luminaire remains operatively connected to a power source without an electrified connection between the displacement member and the support track.

15. The recessed track lighting fixture of claim 3, an illumination opening being defined between the second portions of the first and second side members.

16. The recessed track lighting fixture of claim 15, the luminaire being supported by the displacement member on a side of the displacement member facing the illumination opening.

17. The recessed track lighting fixture of claim 7, wherein the first and second sliding elements comprise nylon.

18. The recessed track lighting fixture of claim 8, wherein the recessed track lighting fixture is attached to the ceiling structure via rods, tubes or cables.

19. The recessed track lighting fixture of claim 9, the positioning means being coupled to the displacement member and including a positioning bracket, an arcuate slot defined in the positioning bracket and one or more positioning apertures defined in the positioning bracket parallel to the arcuate slot, each positioning aperture corresponding to one of a plurality of angular positions.

20. The recessed track lighting fixture of claim 9, the guiding means being coupled to the luminaire and including at least one pin for slidingly supporting the luminaire in the arcuate slot, and a positioning nub, the positioning nub being received by one of the one or more positioning apertures at the desired angular position.

21. A recessed track lighting fixture comprising:

a housing; and an angular adjustment mechanism for a luminaire, the angular adjustment mechanism comprising:

a support bracket coupled to the housing, the support bracket including an arcuate slot and a plurality of positioning apertures, each positioning aperture corresponding to a different position along an arc, at least one pin coupled to the luminaire for slidingly supporting the luminaire in the arcuate slot, and at least one positioning nub coupled to the luminaire, wherein each of the at least one positioning nubs has a curved surface that acts as a cam and wherein the cams of the at least one positioning nubs are received by a corresponding number of the plurality of positioning apertures at a desired position along the arc.

22. The recessed track lighting fixture of claim 21, the at least one arcuate slot comprising two arcuate slots, the two arcuate slots being parallel and arranged on opposite sides of the luminaire.

23. The recessed track lighting fixture of claim 21, the at least one positioning nub comprising two positioning nubs.

24. The recessed track lighting fixture of claim 21, the housing comprising a first side member and a second side member, a linear support track defined between the first and second side members, and a displacement member supported by the support track and displaceable along at least a portion of the support track, wherein the luminaire is at least partially disposed between the first and second side members and the support bracket is supported by the displacement member and is displaceable therewith.

25. The recessed track lighting fixture of claim 10, wherein the pivoting mechanism permits pivoting of the luminaire about an axis that is transverse to the displacement direction.

26. The recessed track lighting fixture of claim 24, the support track including a first channel connected to the first side member and a second channel connected to the second side member, the first and second channels extending in the displacement direction.

27. The recessed track lighting fixture of claim 24, each of the first and second side members having a first portion spaced apart from a second portion, the support track being defined between the first portions of the first and second side members.

28. The recessed track lighting fixture of claim 24, wherein the recessed track lighting fixture is attached to a ceiling structure.

29. The recessed track lighting fixture of claim 24, wherein the support bracket is coupled to the housing by being rotatably coupled to the displacement member.

30. The recessed track lighting fixture of claim 26, the displacement member including first and second supporting portions, wherein the first and second supporting portions are slidably supported by the first and second channels, respectively.

31. The recessed track lighting fixture of claim 26, wherein the first channel and the second channel face each other.

32. The recessed track lighting fixture of claim 30, wherein the first and second supporting portions are first and second ends of the displacement member, respectively.

33. The recessed track lighting fixture of claim 30, further comprising first and second sliding elements connected to the first and second supporting portions, respectively, the first and second sliding elements being received in the first and second channels, respectively.

34. The recessed track lighting fixture of claim 27, an illumination opening being defined between the second portions of the first and second side members.

35. The recessed track lighting fixture of claim 34, the luminaire being supported by the displacement member on a side of the displacement member facing the illumination opening.

36. The recessed track lighting fixture of claim 33, wherein the first channel comprises a first horizontal surface and the second channel comprises a second horizontal surface and at least a portion of the first sliding element rests on the first horizontal surface and at least a portion of the second sliding element rests on the second horizontal surface.

37. The recessed track lighting fixture of claim 33, wherein the first and second channels each have a cross-sectional profile that is complementary to a cross-sectional shape of at least a part of the first and second sliding elements, respectively.

38. The recessed track lighting fixture of claim 33, wherein the first and second channels are structured and arranged to constrain movement of the displacement member perpendicular to the displacement direction.

39. The recessed track lighting fixture of claim 33, the first and second sliding elements each comprising first and second pluralities of connectors for connecting the first and second sliding elements to the first and second supporting portions, respectively.

40. The recessed track lighting fixture of claim 33, the first and second sliding elements comprising a thermoplastic or thermoset material.

41. The recessed track lighting fixture of claim 33, wherein the first and second sliding elements comprise nylon.

42. The recessed track lighting fixture of claim 39, a gap being provided between the first and second pluralities of connectors, one of the first and second supporting portions being received in the gap.

43. The recessed track lighting fixture of claim 39, a connector of the pluralities of connectors including a protrusion which is received in a corresponding aperture in one of the first and second supporting portions.

44. The recessed track lighting fixture of claim 28, wherein the recessed track lighting fixture is attached to the ceiling structure via rods, tubes or cables.

* * * * *